US011401085B2

(12) United States Patent
French et al.

(10) Patent No.: US 11,401,085 B2
(45) Date of Patent: Aug. 2, 2022

(54) SELECTIVELY OPENABLE CLOSURE FOR A CONTAINER

(71) Applicant: Berry Global, Inc., Evansville, IN (US)

(72) Inventors: Jordan Robert French, Evansville, IN (US); Seth A. Tempel, Evansville, IN (US); John A. Vassallo, Lititz, PA (US); Steven Daniel Gift, Lititz, PA (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 16/855,325

(22) Filed: Apr. 22, 2020

(65) Prior Publication Data

US 2020/0339317 A1 Oct. 29, 2020

Related U.S. Application Data

(60) Provisional application No. 62/837,541, filed on Apr. 23, 2019.

(51) Int. Cl.
*B65D 50/04* (2006.01)
*B65D 1/02* (2006.01)

(52) U.S. Cl.
CPC ..... *B65D 50/043* (2013.01); *B65D 1/0246* (2013.01)

(58) Field of Classification Search
CPC .. B65D 50/045; B65D 50/048; B65D 50/043; B65D 41/0471; B65D 1/0246
USPC ..... 215/43
See application file for complete search history.

(56) References Cited

U.S. PATENT DOCUMENTS

| | | | |
|---|---|---|---|
| 3,019,931 | A | 2/1962 | Thornton |
| 3,185,333 | A | 5/1965 | Harold |
| 3,200,979 | A | 8/1965 | Powers |
| 3,447,709 | A | 6/1969 | Marasco |
| 3,623,622 | A | 11/1971 | Sullivan |
| 3,677,431 | A | 7/1972 | Westfall |
| 3,700,133 | A | 10/1972 | Bagguley |
| 3,716,161 | A | 2/1973 | Julian et al. |
| 3,739,933 | A | 6/1973 | Degaetano |
| 3,770,153 | A | 11/1973 | Gach et al. |
| 3,773,203 | A | 11/1973 | Grimaldi et al. |
| 3,805,987 | A | 4/1974 | Horvath |
| 3,877,597 | A | 4/1975 | Montgomery et al. |
| 3,881,625 | A | 5/1975 | Landen |
| 3,884,379 | A | 5/1975 | Landen |
| 3,891,110 | A | 6/1975 | Gach |
| 3,894,647 | A | 7/1975 | Van |
| 3,902,620 | A | 9/1975 | McIntosh |
| 3,971,487 | A | 7/1976 | Montgomery |

(Continued)

FOREIGN PATENT DOCUMENTS

| | | | |
|---|---|---|---|
| CN | 1270904 | A | 10/2000 |
| GB | 2158048 | B | 9/1987 |

(Continued)

OTHER PUBLICATIONS

International Search Report and Written Opinion of corresponding international application No. PCT/US20/29307 dated Jul. 27, 2020, all enclosed pages cited.

*Primary Examiner* — J. Gregory Pickett
*Assistant Examiner* — Niki M Eloshway

(57) ABSTRACT

A closure for a container, and more specifically a closure that is selectively openable and/or lockable providing, for example, one or more child resistant opening features is disclosed.

20 Claims, 19 Drawing Sheets

(56) References Cited

U.S. PATENT DOCUMENTS

| | | | | |
|---|---|---|---|---|
| 3,974,929 | A | 8/1976 | Montgomery | |
| 4,002,259 | A | 1/1977 | Geiser | |
| 4,103,797 | A | 8/1978 | Morris | |
| 4,376,497 | A | 3/1983 | Mumford | |
| 4,427,124 | A | 1/1984 | Marshall et al. | |
| 4,464,316 | A | 8/1984 | Michaels | |
| 4,473,162 | A | 9/1984 | Donoghue | |
| 4,511,049 | A | 4/1985 | Aboud | |
| 4,787,526 | A | 11/1988 | Pehr | |
| 4,809,874 | A | 3/1989 | Pehr | |
| 4,865,209 | A | 9/1989 | Bush | |
| 4,925,041 | A | 5/1990 | Pehr | |
| 5,013,073 | A | 5/1991 | Pehr | |
| 5,038,454 | A | 8/1991 | Thornock et al. | |
| 5,137,260 | A | 8/1992 | Pehr | |
| 5,147,060 | A | 9/1992 | Lima et al. | |
| 5,186,344 | A | 2/1993 | Cook | |
| 5,265,751 | A | 11/1993 | Lima et al. | |
| 5,310,074 | A | 5/1994 | Jochem et al. | |
| 5,348,201 | A | 9/1994 | Koo | |
| 5,394,999 | A | 3/1995 | Krall | |
| 5,411,157 | A | 5/1995 | King et al. | |
| 5,449,077 | A * | 9/1995 | Seidler | B65D 50/045 215/206 |
| 5,454,476 | A | 10/1995 | King et al. | |
| 5,462,182 | A | 10/1995 | Opresco | |
| 5,564,580 | A | 10/1996 | Hamilton et al. | |
| 5,586,671 | A | 12/1996 | Thomas et al. | |
| 5,794,803 | A | 8/1998 | Sprick | |
| 5,954,240 | A | 9/1999 | Duchon et al. | |
| 5,986,401 | A | 11/1999 | Thompson et al. | |
| 5,988,412 | A | 11/1999 | Minnette et al. | |
| 6,020,397 | A | 2/2000 | Matzinger | |
| 6,053,343 | A | 4/2000 | Krueger | |
| 6,102,223 | A | 8/2000 | Montgomery | |
| 6,112,921 | A | 9/2000 | Robinson | |
| 6,152,315 | A | 11/2000 | Minette | |
| 6,343,705 | B1 | 2/2002 | Minette | |
| 6,612,450 | B1 | 9/2003 | Buono | |
| 7,000,789 | B2 | 2/2006 | Miceli et al. | |
| 8,424,705 | B2 | 4/2013 | Palmer et al. | |
| 9,851,039 | B2 | 12/2017 | Roell et al. | |
| 10,252,842 | B2 | 4/2019 | Miceli et al. | |
| 10,285,520 | B2 | 5/2019 | Dunn et al. | |
| 2004/0195197 | A1 | 10/2004 | Miceli et al. | |
| 2006/0213861 | A1 | 9/2006 | Konefal et al. | |
| 2006/0273060 | A1 | 12/2006 | Fricke | |
| 2007/0102856 | A1* | 5/2007 | Kerr | F16F 1/3732 267/182 |
| 2007/0187351 | A1 | 8/2007 | Robinson | |
| 2008/0116163 | A1 | 5/2008 | Sawyer | |
| 2010/0005641 | A1 | 1/2010 | Druitt et al. | |
| 2010/0051572 | A1* | 3/2010 | Beecroft | B65D 50/048 215/216 |
| 2010/0147732 | A1 | 6/2010 | Delagrance et al. | |
| 2010/0206877 | A1 | 8/2010 | Logel et al. | |
| 2013/0075403 | A1* | 3/2013 | Van Geel | B65D 47/0838 220/288 |
| 2013/0097973 | A1* | 4/2013 | McCoy | A61J 1/05 53/467 |
| 2013/0126530 | A1* | 5/2013 | Morris, Jr. | B65D 50/046 220/288 |
| 2014/0284299 | A1* | 9/2014 | Barber | B65D 50/046 215/44 |
| 2015/0321804 | A1* | 11/2015 | Koller | B65D 1/0246 215/44 |
| 2016/0340090 | A1 | 11/2016 | Melia | |
| 2017/0113851 | A1* | 4/2017 | Martin | B65D 50/043 |
| 2017/0259966 | A1* | 9/2017 | Cerveny | B29C 49/0073 |
| 2017/0349341 | A1* | 12/2017 | Girardot | B65D 50/046 |
| 2019/0276201 | A1* | 9/2019 | French | B65D 50/043 |
| 2020/0198856 | A1* | 6/2020 | Sterling | B65D 50/046 |

FOREIGN PATENT DOCUMENTS

| | | | | |
|---|---|---|---|---|
| JP | 2014101137 A * | 6/2014 | | B65D 41/34 |
| WO | WO-9004546 A2 * | 5/1990 | | B65D 50/046 |
| WO | 2005037659 A3 | 10/2005 | | |

* cited by examiner

SELECTIVELY OPENABLE CLOSURE FOR A CONTAINER

PRIORITY CLAIM

This application claims priority under 35 U.S.C. § 119(e) to U.S. Provisional Application Ser. No. 62/837,541 filed Apr. 23, 2019, which is expressly incorporated by reference herein.

TECHNICAL FIELD

The present disclosure relates generally to a closure for a container, and more specifically to a closure that is selectively openable and/or lockable providing, for example, one or more child resistant opening features.

BACKGROUND

It is often desirable to make a container selectively openable by providing a closure for the container. For example, the closure may be selectively opened and closed and may include a locking or blocking feature that makes it more difficult or resistant to opening by a child.

SUMMARY

Certain embodiments according to the present disclosure provide a selectively openable closure for a container.

In one aspect, for instance, some embodiments may provide a package that includes a container defining a product storage region and a closure coupled to the container. The closure covers the product storage region and blocks access to the product storage region when in a closed position. The closure includes a skirt and a key. The key is selectively movable relative to the closure skirt by a first user input between a locked position and an unlocked position. The key includes a key protrusion in alignment with a neck blocking tab coupled to a neck of the container when the key is in the locked position blocking rotation of the closure relative to the container. The key protrusion is moved out of alignment with the neck blocking tab when the key is in the unlocked position allowing rotational removal of the closure from the container by a second user input moving the closure from a closed position to an open position. The key is movable in a vertical direction transverse to a radial direction of the closure.

In another aspect, for instance, some embodiments may provide a closure for forming a child-resistant package when combined with a container. The closure includes a cover, an outer skirt depending downwardly from the cover adjacent an outer periphery of the cover, and an inner skirt depending downwardly from the cover and disposed radially inwardly of the outer skirt. A skirt thread on an inner surface of the inner skirt is configured to releasably engage a thread of the container. A key is coupled to at least one of the outer skirt and the inner skirt, wherein the key is movable by a user input from a locked position to an unlocked position. The key is moved at least one of upwardly in a direction toward the cover and radially outwardly in a direction away from the inner skirt when moved from the locked position to the unlocked position. The key may be moved in a vertical direction when moved between the locked and unlocked position.

In yet another aspect, for instance, some embodiments may provide a package that includes a container having a floor, a side wall, and a neck, wherein the floor and side wall at least partially defining a product storage region. A blocking tab is coupled to and extends radially outwardly from the container neck. A closure has a cover configured to block access to the product storage region when the closure is in a closed position, the closure having an inner skirt and an outer skirt. A key is coupled to the closure and movable by a first user input in a vertical direction from a locked position to an unlocked position. The closure inner skirt has an internal thread configured to engage an external thread of the container neck and configured to allow rotational movement by a second user input between a closed position and an open position. Rotation in a direction moving the closure from the closed position to the opened position is blocked by interaction of the neck blocking tab of the container and a key protrusion of the key. The key is coupled to at least one of the inner skirt and outer skirt. The key extends from a key grip area configured to be actuated in a direction toward the closure cover by the first user input. At least one flexing member accommodates movement when subject to the first user input between the locked position and the unlocked position, wherein the flexing member is biased toward the locked position so that the key tends to return to the locked position in the absence of the first user input.

BRIEF DESCRIPTION OF THE DRAWINGS

The detailed description particularly refers to the accompanying figures, in which.

DETAILED DESCRIPTION

Embodiments now will be described more fully hereinafter with reference to the accompanying drawings, in which some, but not all embodiments are shown. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
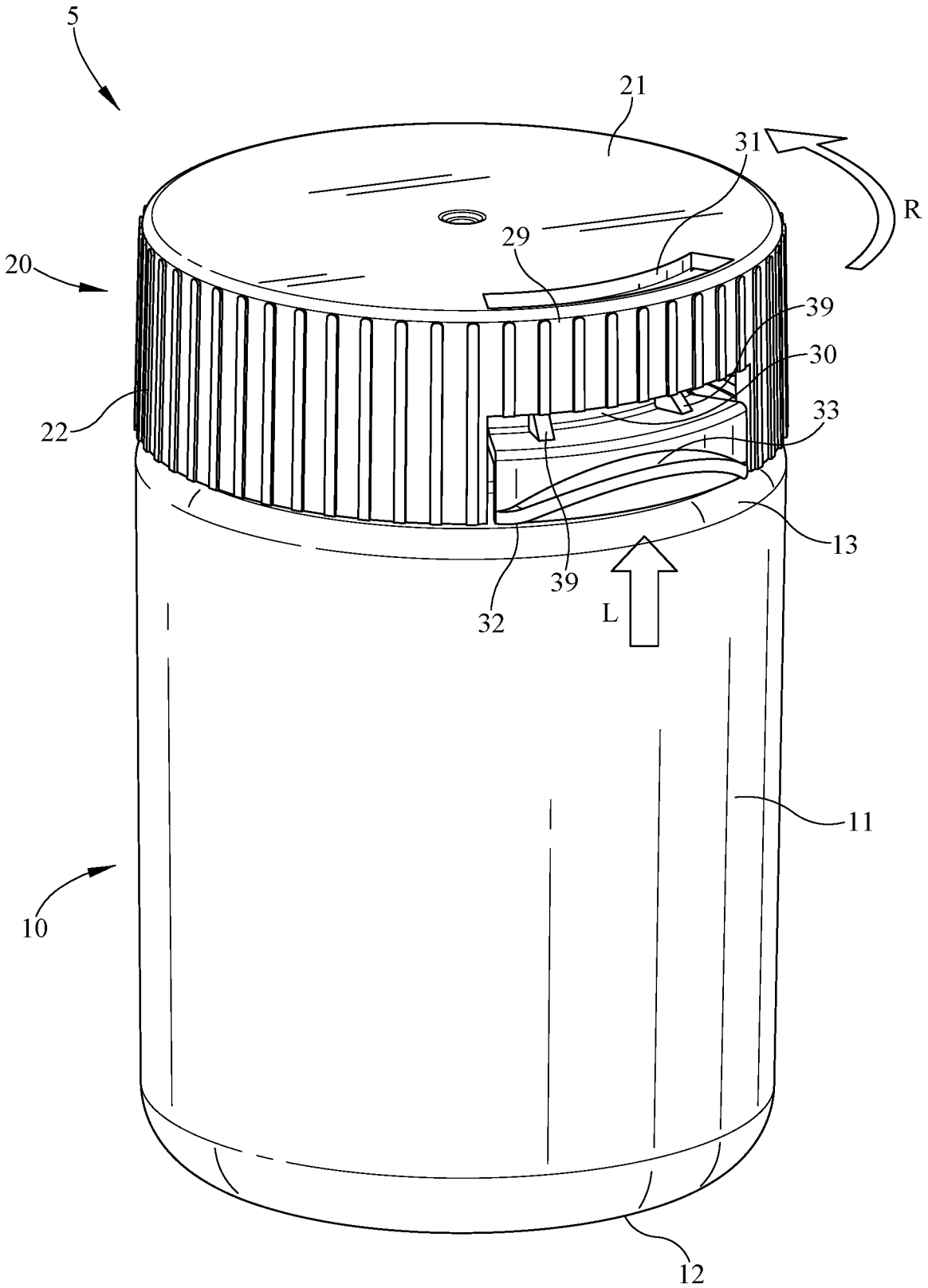
FIG. 1 illustrates a perspective view of an exemplary embodiment of a package that includes a container and a closure in a closed position and a locked position.

Some embodiments of a package 5 such as shown in FIG. 1 may provide a closure 20 that may be selectively unlocked to allow removal of closure 20 from a bottle or container 10. Container 10 may include a side wall 11, a floor 12, and/or a shoulder 13, any or all of which may substantially define a product storage region 19 in container 10 (product storage region 19 is shown, for example, in FIG. 3). Package 5 is shown in FIG. 1 in an exemplary closed position with closure 20 attached, coupled, and/or fastened to container 10. For example, closure 20 may be threaded and/or may thread or screw on to container 10, which may also be threaded. Closure 20 may be configured so that a user may selectively move closure 20 from a closed position, in which it substantially blocks or prevents access to product storage region 19, to an open position in which it is at least partially removed from container 10 so that, for example, a user may access product storage region 19 and/or contents of container 10 and/or package 5. For example, a user may unthread or unscrew closure 20 from container 10, and/or move the closure 20 and/or package 5 from a closed position to an open position, by rotating closure 20 as indicated by rotation R to loosen and/or remove it from container 10. Closure 20 may be provided such that a user may selectively move it from the open position to the closed position and/or to reclose container 10 and/or package 5 by reclosing, reconnecting, rethreading, or reattaching closure 20 to container 10. A user may selectively provide an input to rotate closure 20 and/or to move closure 20 between a closed position as shown for example in FIG. 1 and an open position as shown for example in FIG. 7.

Package 5 may include a feature such as a key 30 that is movable between a locked position and an unlocked position, as shown for example in FIG. 1. As described in more detail below, key 30 may be provided in a locked position in which it substantially blocks, prevents, and/or inhibits moving closure 20 from a closed position to an open position, for example, by preventing rotation R of closure 20 relative to container 10 and/or removal of closure 20 from container 10. Key 30 may be selectively movable by a user input from a locked position to an unlocked position. For example, key 30 or a component thereof may interact with container 10 or a component thereof to prevent rotation R of closure 20 relative to container 10 by providing a mechanism, when key 30 and/or closure 20 is in the locked position, to substantially block, prevent, and/or inhibit rotation R of closure 20 and/or moving closure 20 from a closed position to an open position. A blocking mechanism, for example, may include mechanical, frictional, and/or interference, or any combination thereof. A user may selectively provide an input to move key 30 from a locked position to an unlocked position, for example, by pushing or lifting a key grip 33 as indicated by lift L.

As shown in FIG. 1, lift L may be at least partially in a vertical direction to move key 30 upwardly relative to container 10 and/or from the locked position to an unlocked position. The vertical direction may be at least partially transverse and/or perpendicular to a radial direction, in which the radial direction extends from the center of package 5 and/or container 10 outwardly toward the side wall 11 and/or outer skirt 22, for example. In an unlocked position, key 30 may be substantially free to rotate past the mechanism that blocked, prevented, or inhibited rotation R, for example, when key 30 is in the locked position. In some embodiments, key 30 may be biased toward the locked position to provide package 5 and/or closure 20 in a locked position or condition when closure 20 is coupled to container 10 absent a user input to unlock package 5, closure 20, and/or key 30. As discussed more below, key 30 may be biased downwardly in a vertical direction so that key 30 tends to move toward the locked position when in the unlocked position.

Figure 2:
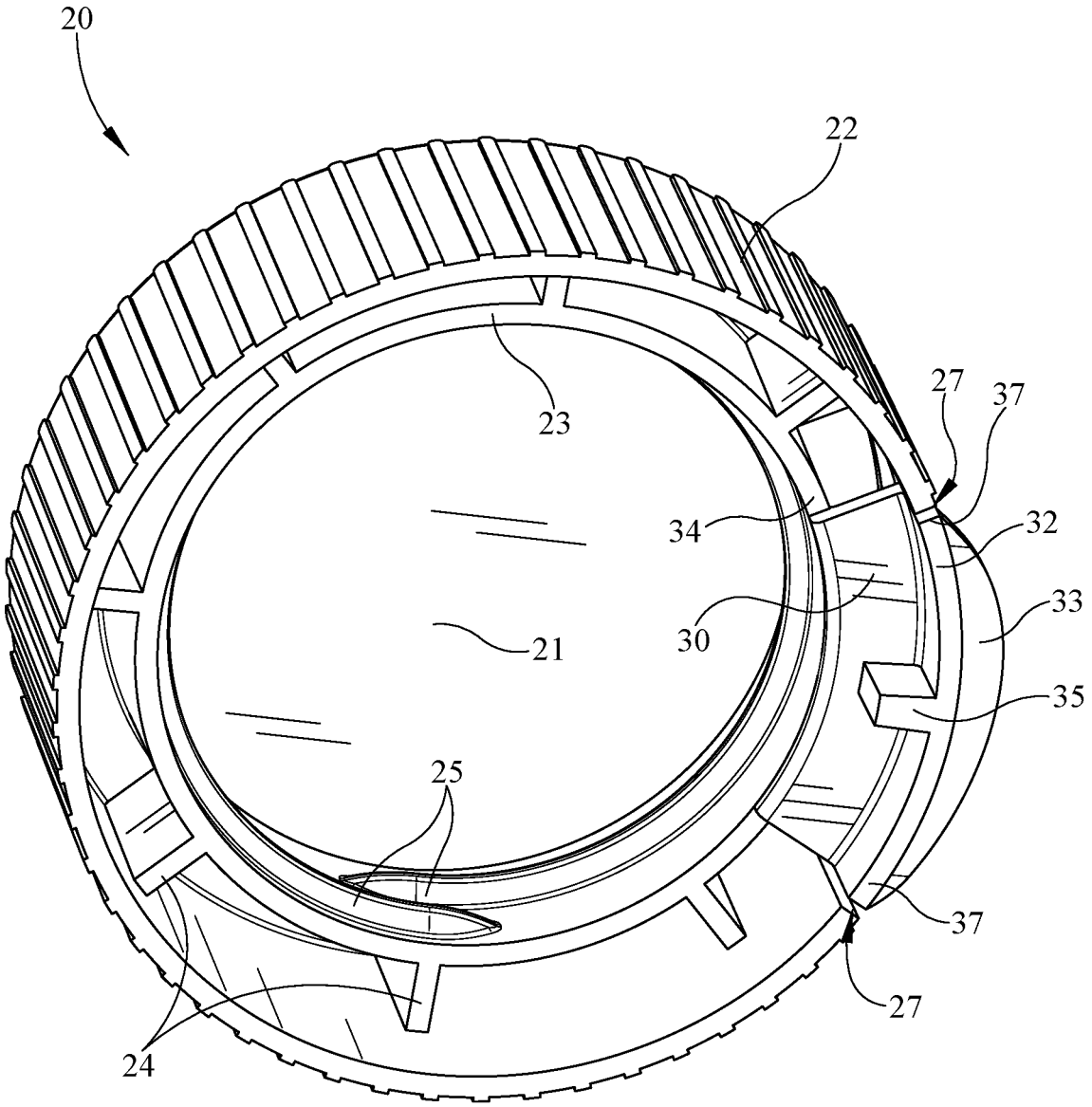
FIG. 2 illustrates a bottom perspective view of the closure of FIG. 1 shown in a locked position.
Figure 3:
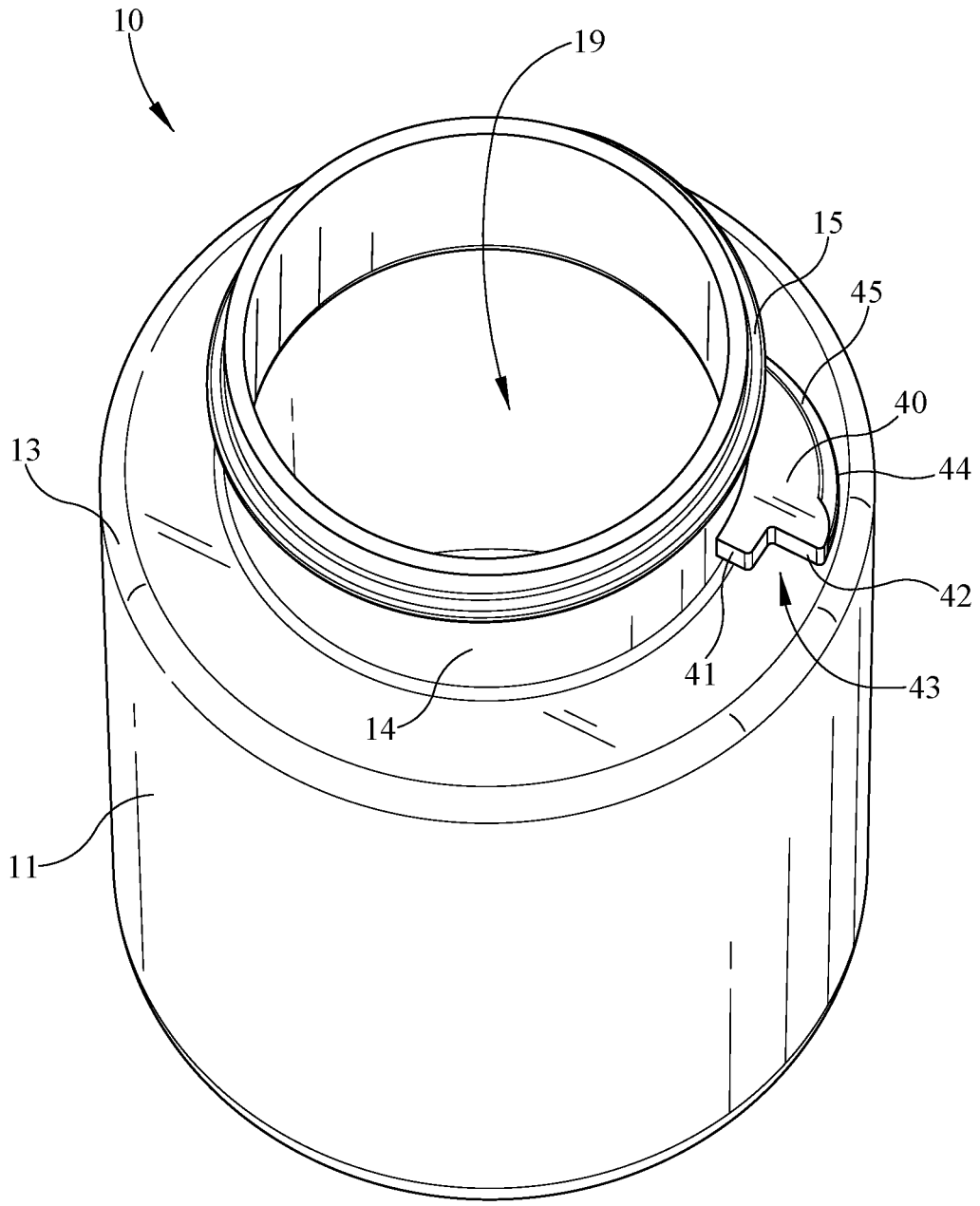
FIG. 3 illustrates a perspective view of an embodiment of a container shown in an open position without a closure.

As shown in FIGS. 2 and 3, closure 20 may couple, connect, and/or attach to container 10 by an attachment mechanism such as the threaded engagement between neck threads 15 on container neck 14 and closure threads 25 on closure 20. If closure 20 is coupled to container 10 by corresponding respective threads 25, 15 closure 20 may be removed from container 10 by rotating closure 20 relative to container 10. It is understood that other attachment mechanisms may be included, such as snap fit, friction fit, and/or integral formation of closure 20 and container 10, for example. Package 5 and/or closure 20 may include a key 30 that is movable between a locked position in which it blocks removal and/or rotation of closure 20 relative to container 10 in at least a removal direction (e.g., counter-clockwise) and a locked position in which it does not block removal or removal rotation of closure 20 relative to container 10. Closure 20 may include a lid 21 configured to block access to product storage region 19 when closure 20 and/or package 5 is in a closed position, for example, with closure 20 coupled or attached to container neck 14. Closure 20 may be removed to provide an open position in which lid 21 is removed from blocking access to product storage region (see, e.g., FIG. 3).

As shown in FIGS. 1-3, key 30 may extend from a top edge 31 to a bottom edge 32, along a key body 34, and/or may include key grip 33, for example, to facilitate a user pushing, lifting, and/or moving key 30 upwardly and/or outwardly from a locked position to an unlocked position, for example. Key 30 may include a key protrusion 35, which may for example extend radially inwardly to engage a corresponding neck blocking tab 40 coupled to neck 14 of container 10. When key 30 is in a locked position, key protrusion 35 may form a mechanical stop with neck blocking tab 40 to prevent rotation R in at least one direction, to prevent moving closure 20 from a closed position to an open position, and/or to prevent removal of closure 20 from container 10. A user may lift or move key 30 relative to a closure outer skirt 22, container 10, and/or blocking tab 40 to remove key protrusion 35 from circumferential alignment with neck blocking tab 40, for example by lift motion L, to arrive at one example of an unlocked position, in which key protrusion may rotate past blocking tab 40 substantially without interference. A user may then rotate closure 20 to remove it and arrive at an open position in which closure 20 may be removed from container 10. Closure 20 may include outer skirt 22 and/or an inner skirt 23 for any of a variety of reasons, including but not limited to providing a substantially uniform outer diameter or circumference with container side wall 11 while also allowing threaded engagement with neck 14 having a smaller outer diameter or circumference than side wall 11. Outer skirt 22 may provide additional protection of neck 14 and/or inner skirt 23 or any component thereof and/or may provide a more pleasing aesthetic by being more uniform in size and/or shape with container side wall 11. Closure inner skirt 23 may be connected to outer skirt 22 by one or more closure ribs 24, which may be provided for any of a variety of reasons, including, but not limited to, adding strength and/or structural rigidity to closure 20.

As shown in FIG. 3, neck blocking tab 40 may include a first extension 41 and/or a second extension 42 either or both of which may be configured to engage key protrusion 35, for example with neck notch 43 abutting key protrusion 35 when in the locked position. Neck blocking tab 40 may extend from a first end 45 toward an oppositely disposed end at first extension 41 and/or second extension 42. An upper surface of neck blocking tab 40 may be inclined, for example, lower proximate first end 45 and higher proximate first extension 41 to provide a cam surface or ramp so that closing rotation of closure 20 relative to container 10 may move key 30 upwardly to facilitate transitioning key 30 from an unlocked position to a locked position without necessitating a user to lift key 30 while closing closure 20 on container 10.

Closure 20 may include one or more key notches 27 between outer skirt 22 and key 30 to facilitate secure or rigid coupling to and/or integration of key 30 with closure 20 while allowing motion of key 30 relative to closure 20 to facilitate moving key 30 and/or key protrusion 35 from a locked position to an unlocked position, as shown for example in FIG. 2. It is understood that, in some embodiments, key notches 27 may include webs of weakened, flexible, and/or thinned material instead of or in addition to gaps or discontinuities to allow motion of key 30 relative to outer skirt 22. Closure 20 may include a bumper 29 for any of a variety of reasons, including but not limited to, partially covering and/or obscuring key 30 and/or key body 34 and/or providing a substantially consistent outer perimeter or circumference of outer skirt 22.

Key 30 may be biased toward a locked position, shown for example in FIG. 2. For example, key 30 may be inherently biased toward maintaining its original shape providing key protrusion 35 in a locked position in which it is in circumferential and/or radial alignment with blocking tab 40 when closure 20 is coupled to container 10. The bias of key 30 toward this locked position may be overcome by a user input deflecting it outwardly and/or upwardly, for example, rotating about an area where key 30 and/or key body attaches to the rest of closure 20, which may be at or near closure cover 21, and/or closure inner skirt 23 for example, and/or key 30 may flex and/or deflect along its length from bottom edge 32 to top edge 31 and/or along key body 34. Deflection and/or flexure of key 30 is shown in more detail, for example, in FIGS. 5 and 8. It is understood that other biasing or spring-like elements may be included such as a compression material or spring, or a tension material, elastic material, or flexible material to bias key 30 toward the locked position so that the resting state of key 30 is in the locked position.

Figure 4:
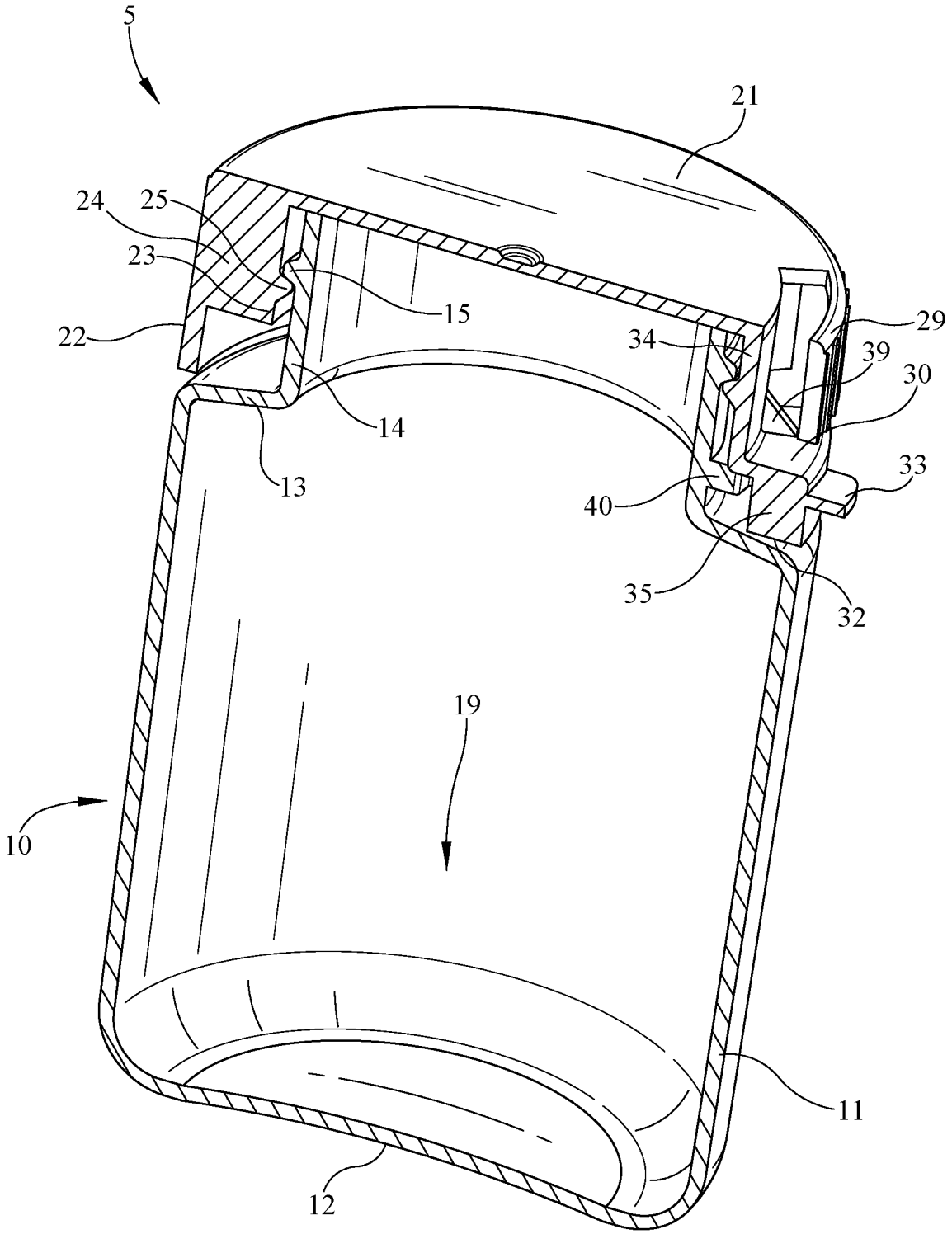
FIG. 4 illustrates a perspective cross-section view of the package of FIG. 1 shown in a locked position and a closed position.
Figure 5:
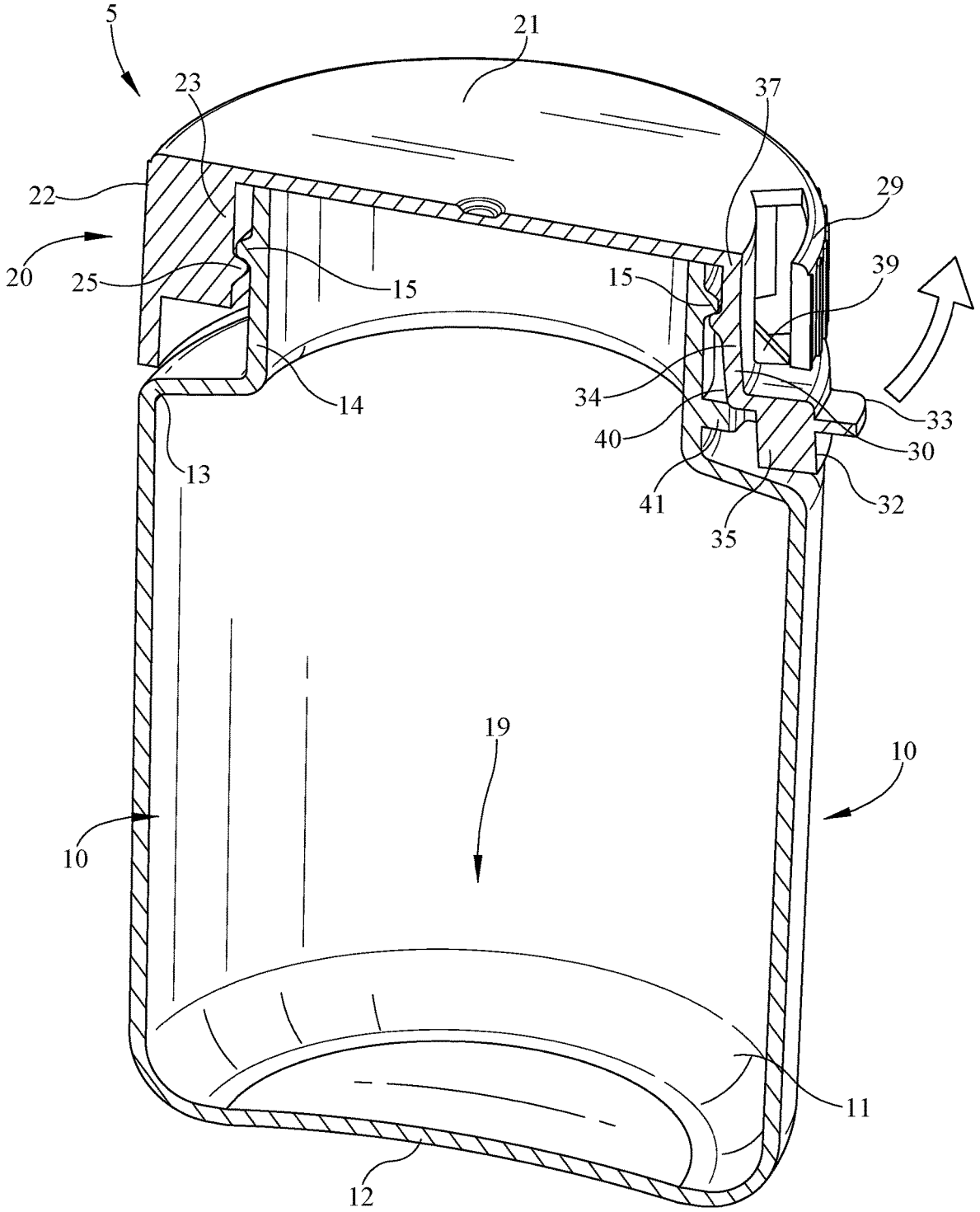
FIG. 5 illustrates a perspective cross-section view of the package of FIG. 1 in an unlocked position and a closed position.
Figure 6:
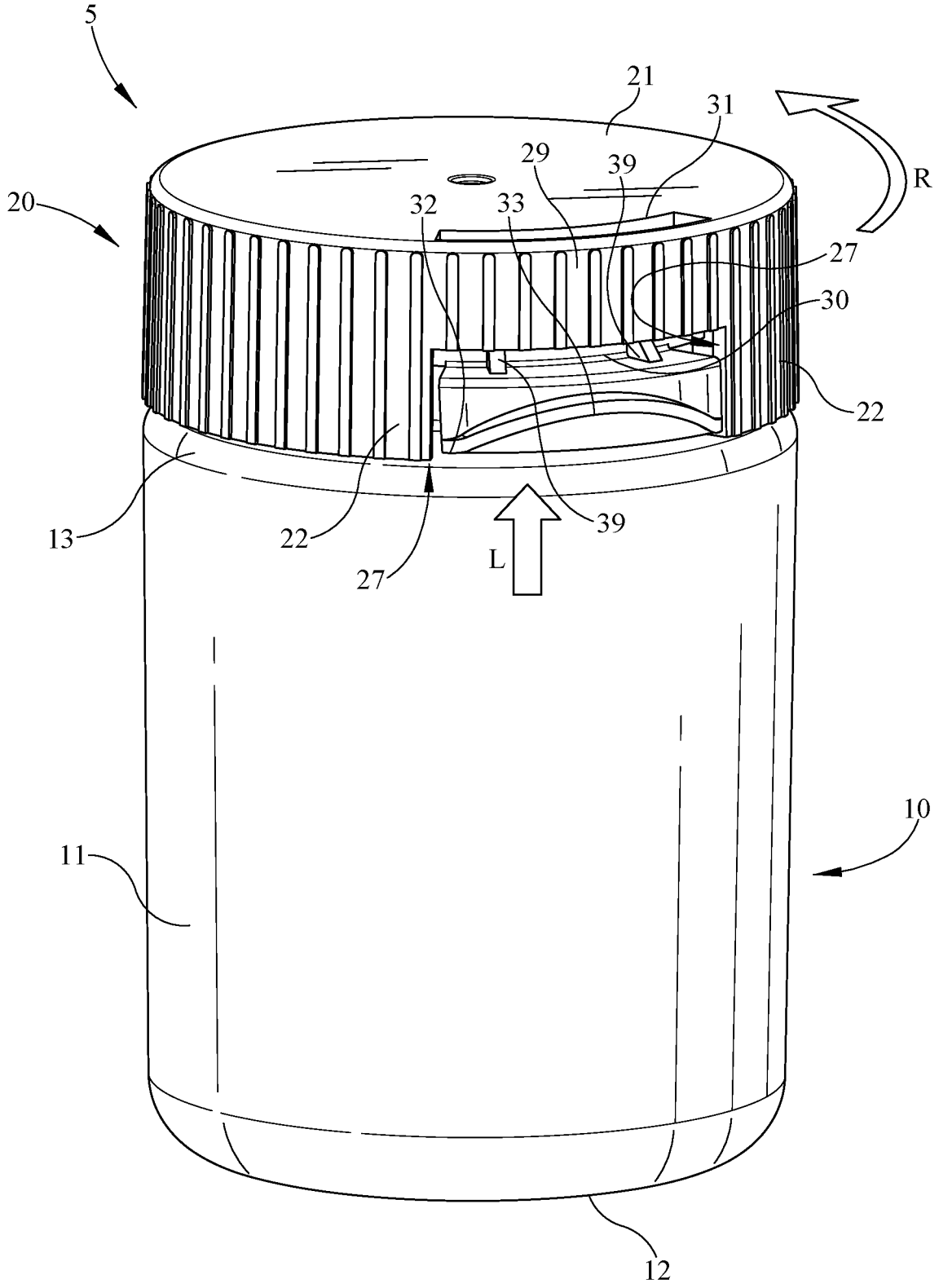
FIG. 6 illustrates a front perspective view of the package of FIG. 5 in an unlocked position.
Figure 7:
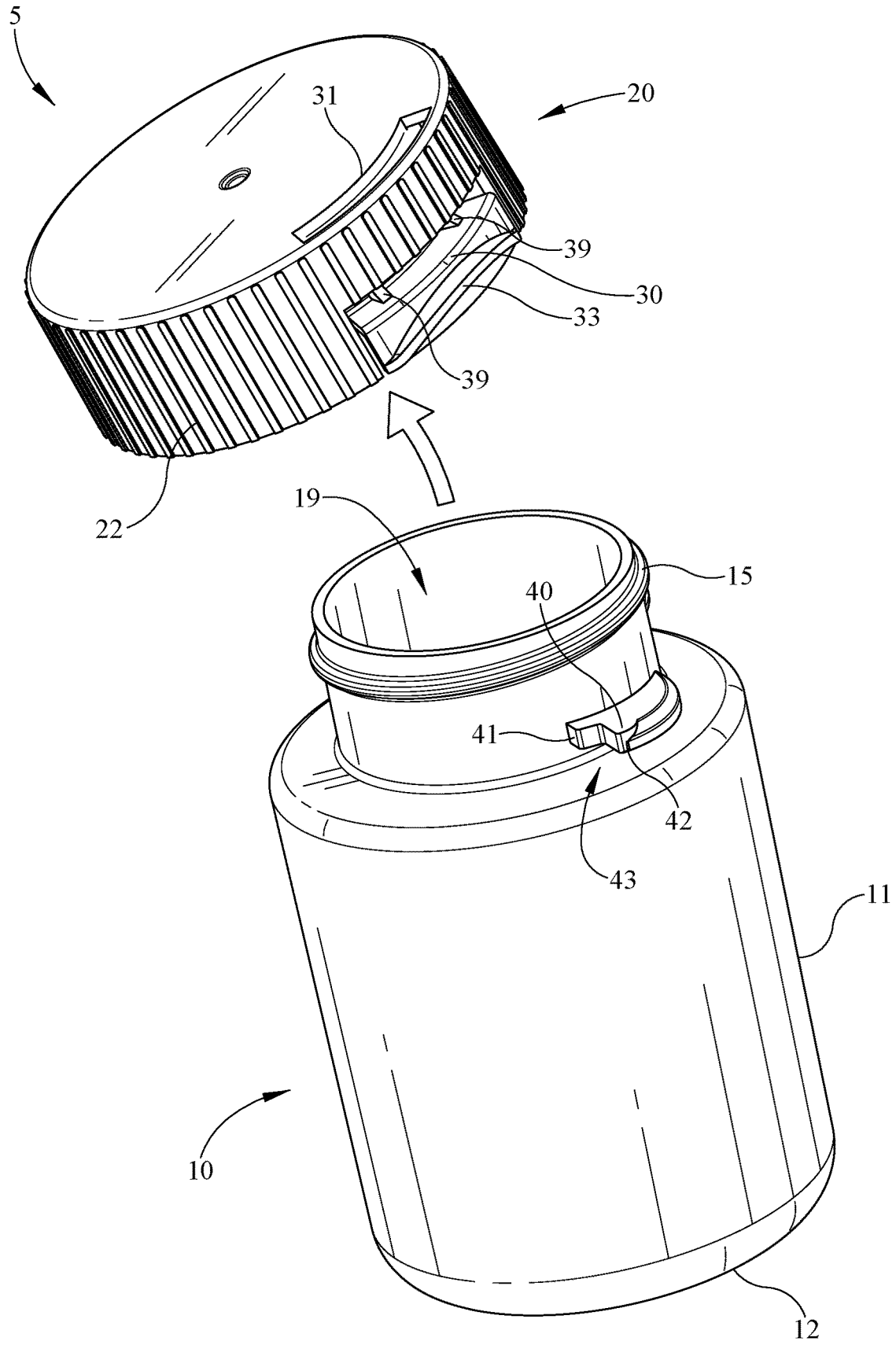
FIG. 7 illustrates a perspective view of the package of FIG. 5 in an open position.

One embodiment of package 5 in a closed and locked position is shown in FIG. 4, in which package 5 is not being subject to a lifting or unlocking user input or motion at key 30 nor a rotational or opening user input or motion on closure 20. In FIG. 5, package 5 is being subject to a lifting or unlocking user input at key grip 33, which deflects key 30 upwardly and outwardly as indicated by the arrow to move the key 30, closure 20, and/or package 5 form a locked position to an unlocked position. As shown, in some embodiments key 30 may bend, flex, and/or deflect along its length, for example, along key body 34, and/or it may rotate about a hinge area 37 where key 30 may attach to closure 20, for example at cover 21. Hinge area 37 may be located at or near an area where key 30 attaches to inner skirt 23 and/or outer skirt 22. Key 30 may include one or more key ribs 39 for any of a variety of reasons, including but not limited to, adding structural rigidity to key 30. Package 5 is shown in FIG. 6 as subject to both the unlocking or lifting input indicated by lift L and the opening or rotational input indicated by rotation R. With key 30 moved to an unlocked position and rotation or opening substantially unblocked, a user may rotate closure 20 to move closure 20 and/or package 5 from a closed position to an open position. As shown in FIG. 7, closure 20 may be removed from container 10 to provide an open position in which a user may be provided with access to contents of container 10, for example, stored in product storage region 19.

Figure 8:
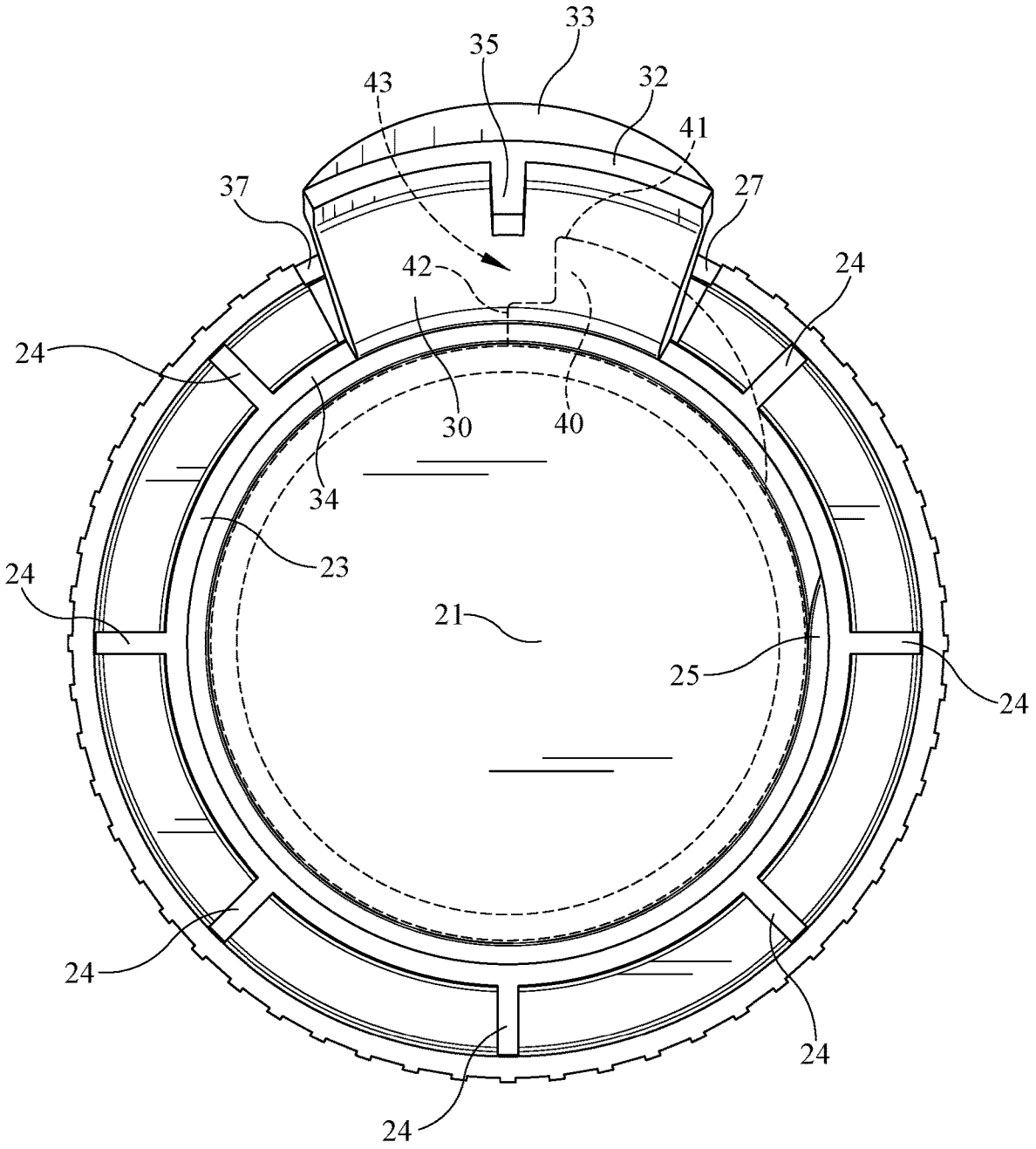
FIG. 8 illustrates a bottom view of the closure of FIG. 5 shown in an unlocked position.

FIG. 8 illustrates key 30 in an unlocked position and how it may be configured relative to blocking tab 40 of container 10. As shown in this example, when key 30 is deflected upwardly and/or outwardly relative to blocking tab 40, key 30 and/or key protrusion 35 may be provided so that it extends radially outward of blocking tab 40 and/or free to rotate past blocking tab 40.

Figure 9:
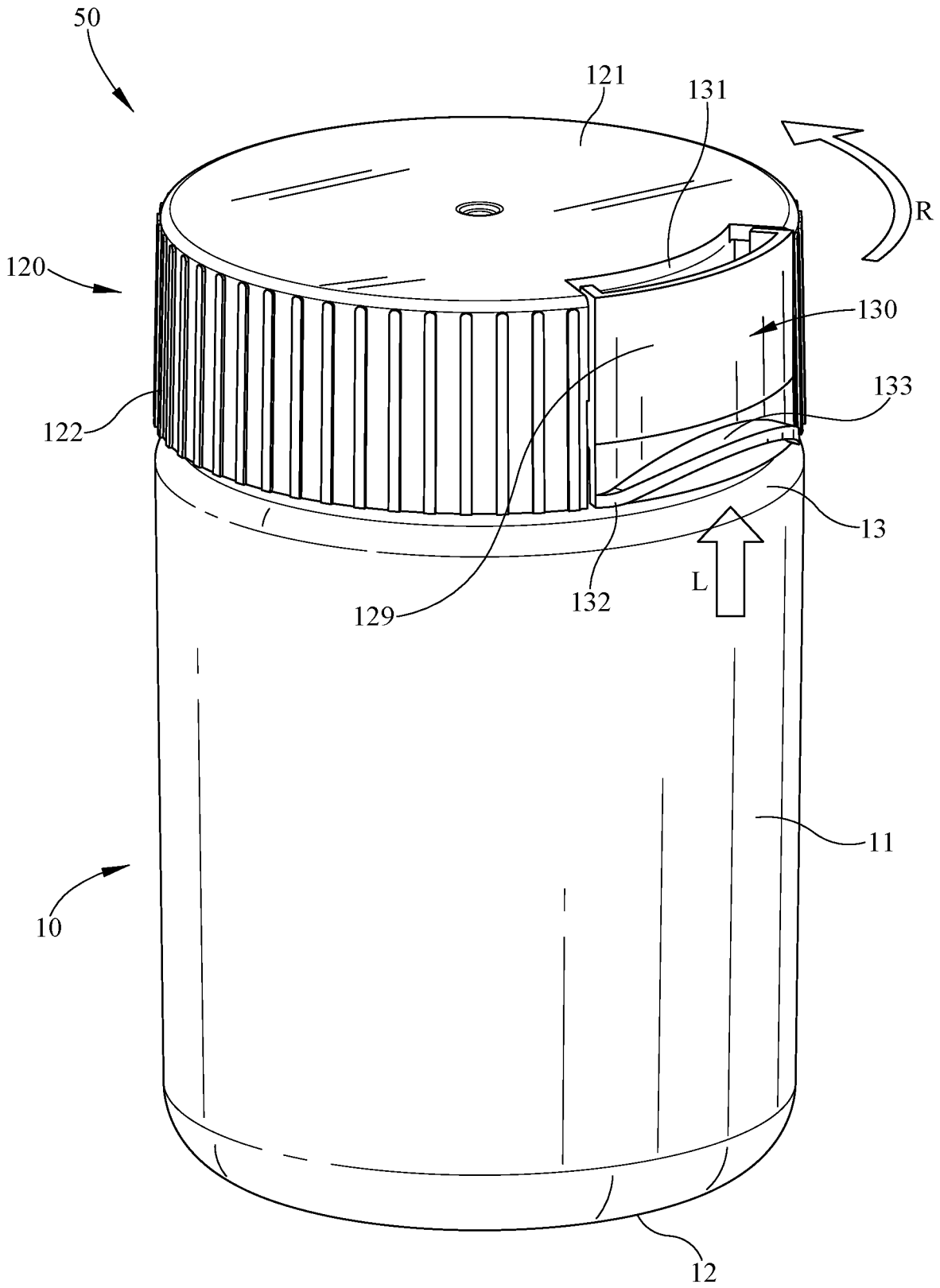
FIG. 9 illustrates a perspective view of another embodiment of a package including a container and a closure in a locked position and a closed position.
Figure 10:
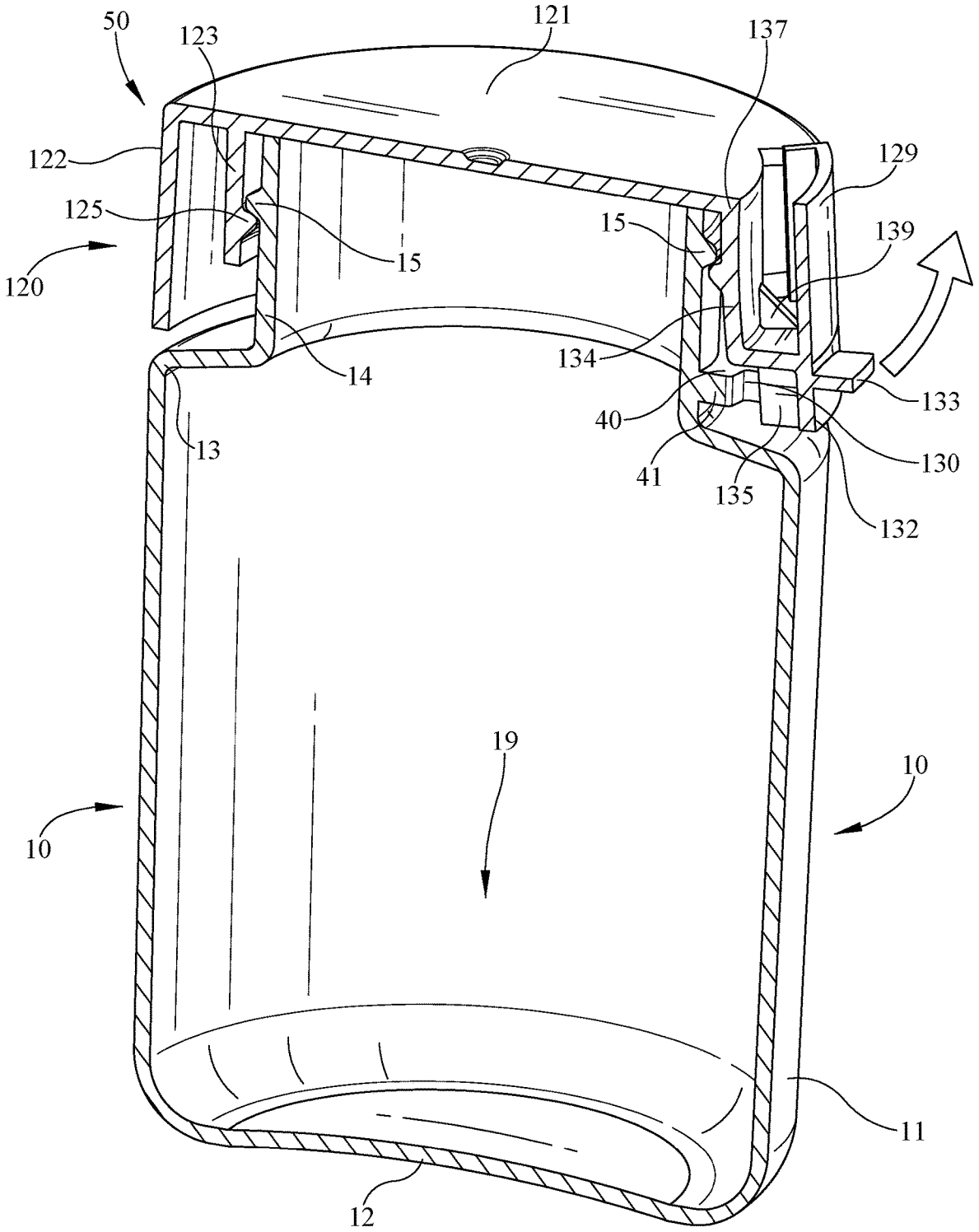
FIG. 10 illustrates a perspective cross-section view of the package of FIG. 9 in an unlocked position and a closed position.
Figure 11:
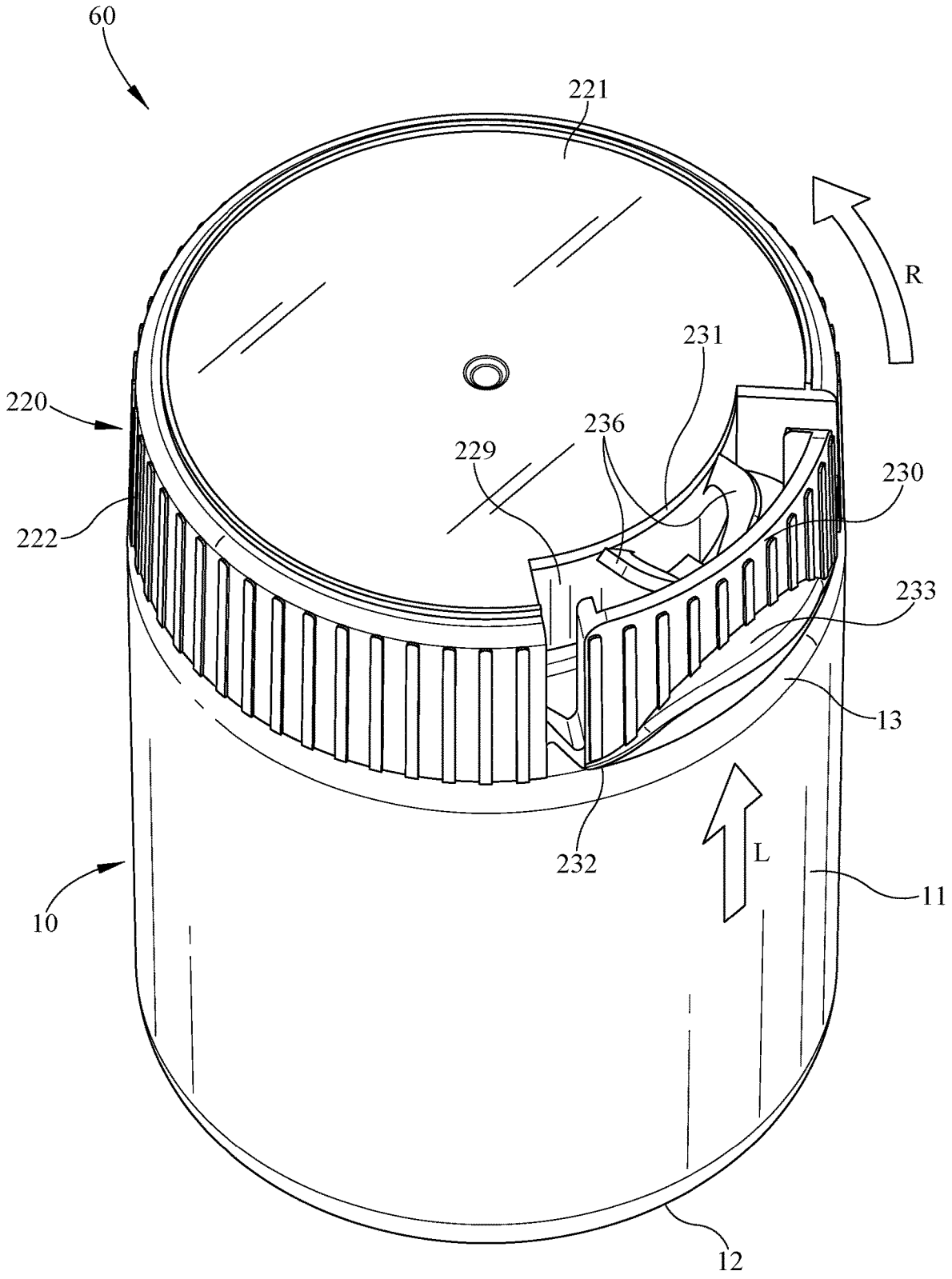
FIG. 11 illustrates a perspective view of yet another embodiment of a package including a container and a closure in a locked position and a closed position.
Figure 12:
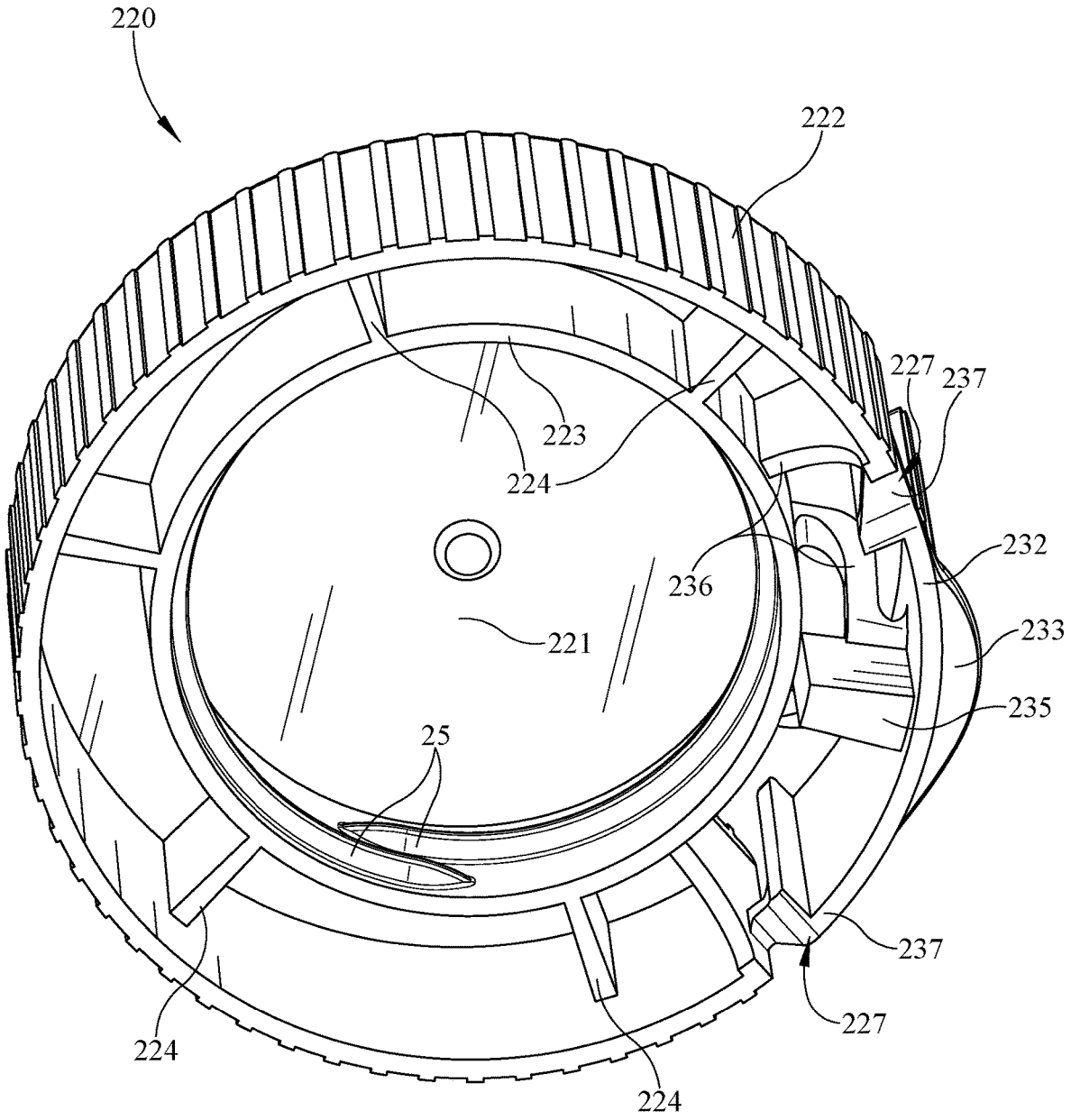
FIG. 12 illustrates a bottom perspective view of the closure of FIG. 11 shown in a locked position.
Figure 13:
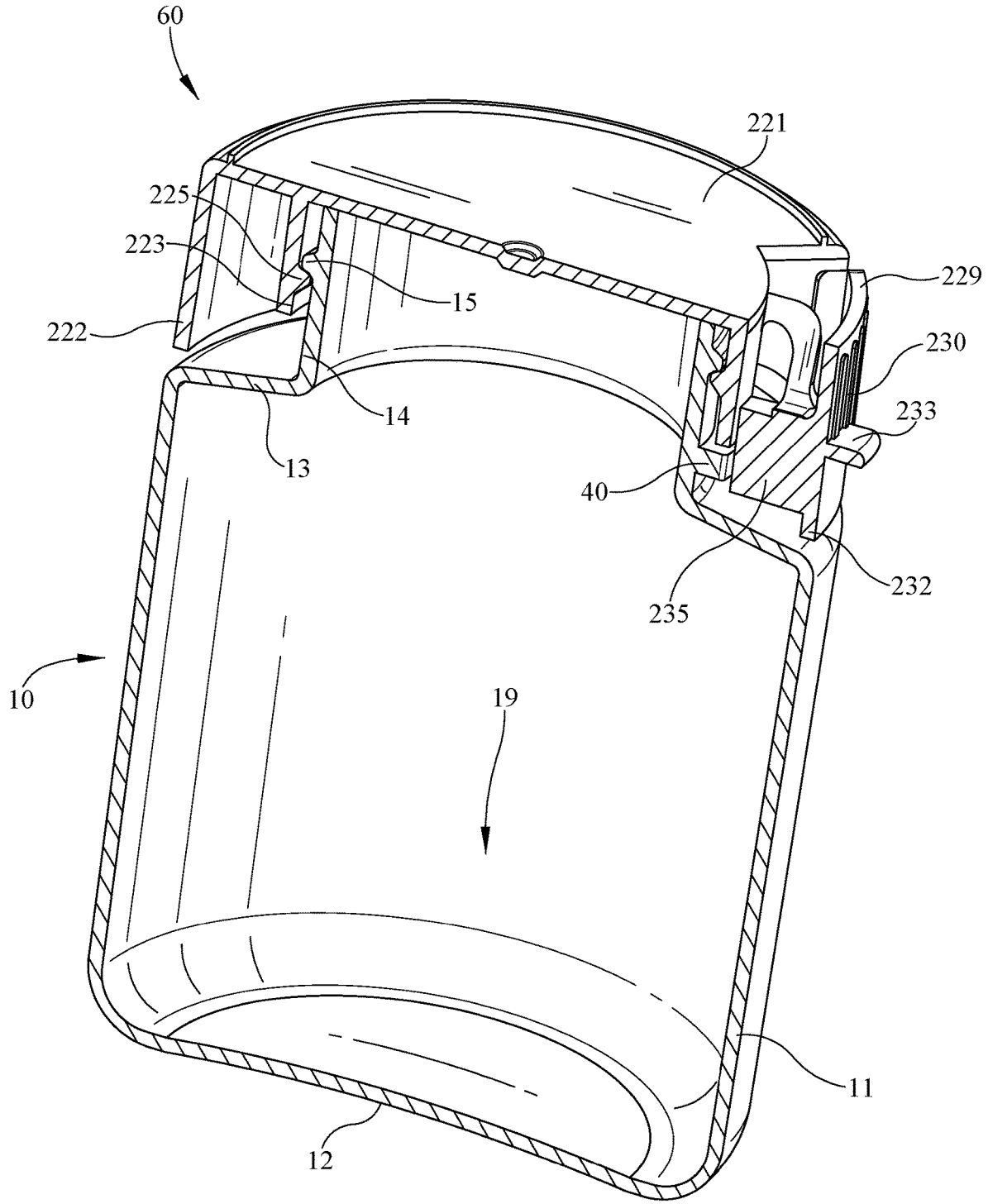
FIG. 13 illustrates a perspective cross-section view of the package of FIG. 11 shown in a locked position and a closed position.
Figure 14:
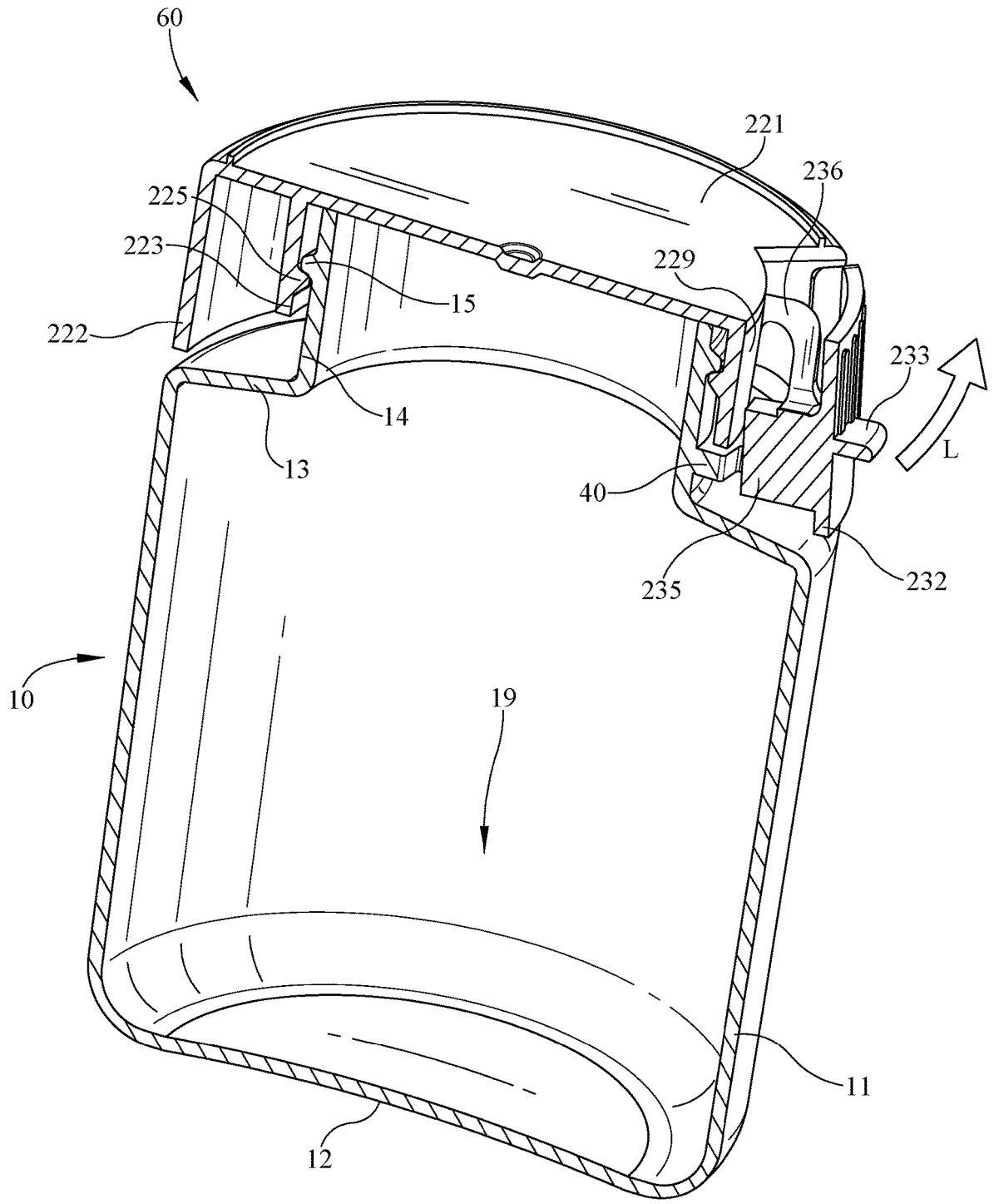
FIG. 14 illustrates a perspective cross-section view of the package of FIG. 11 in an unlocked position and a closed position.
Figure 15:
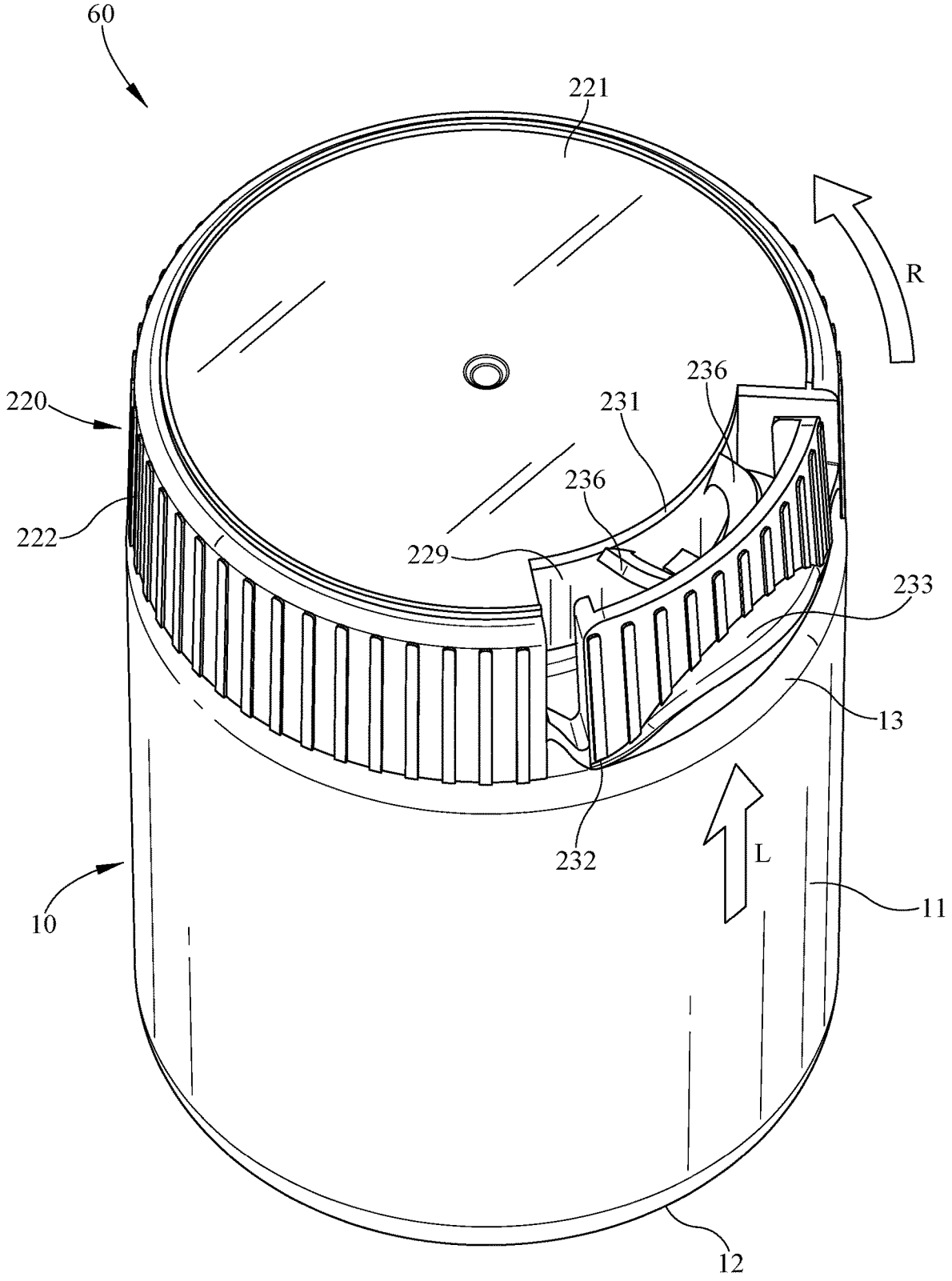
FIG. 15 illustrates a front perspective view of the package of FIG. 14 in an unlocked position.

FIGS. 9 and 10 show a second embodiment of a package 50, including container 10, a closure 120, and a key 130. FIG. 9 shows a perspective view of package 50 in a closed position and a locked position that, when subject to lift L and rotation R, may be moved to an unlocked position and an open position, substantially as described above in relation to package 5. In principle, package 50 operates similarly to package 5. Package 50 includes a key bumper 129 that may be provided for any of a variety of reasons, including but not limited to, partially covering and/or obscuring key body 134 and/or providing a substantially consistent outer perimeter or circumference with closure outer skirt 122.

In the embodiment shown in FIGS. 9 and 10, closure 120 may include any or all of a top, lid, or cover 121, an outer skirt 122, an inner skirt 123, and a skirt thread 125. Although not shown, one or more closure ribs may be included to add structural rigidity, or for any other reason, for example, substantially in the manner as closure ribs 24 shown and discussed above with reference to FIGS. 1-8. As shown for example in FIG. 10, in some embodiments key 130 may bend, flex, and/or deflect along its length, for example, along key body 134, and/or it may rotate about a hinge area 137 where key 130 may attach to closure 120, for example at cover 121. Hinge area 137 may be located at or near an area where key 130 attaches to inner skirt 123 and/or outer skirt 122.

Referring now to FIGS. 11-15, a third embodiment of a package 60 is shown including another embodiment of a closure 220. In this embodiment, one or more flexing members, such as key arms 236, may be included, for any of a variety of reasons, including but not limited to coupling a key 230 to an attachment surface 229 of closure 220 and/or closure inner skirt 223. In use, for example, when key 230 is subject to a first user input, such as an upward pushing or lifting force L, key 230 may move from a locked position in which it blocks, prevents, or inhibits rotation R and/or removal of closure 220 from container 10 to allow access to product storage region 19, by the flexing and/or deformation of key arms 236 at least partially in a vertical direction in relation to lift L. Key arms 236 may be configured to return to their original shape, for example, to bias key 230 toward the locked position so the key 230 may tend toward the locked position in the absence of the first user input. One or more structural ribs 224 may be included for any of a variety of reasons, including, but not limited to, adding structural rigidity to closure 220. For example, ribs 224 may connect outer skirt 222 to inner skirt 223.

Figure 16:
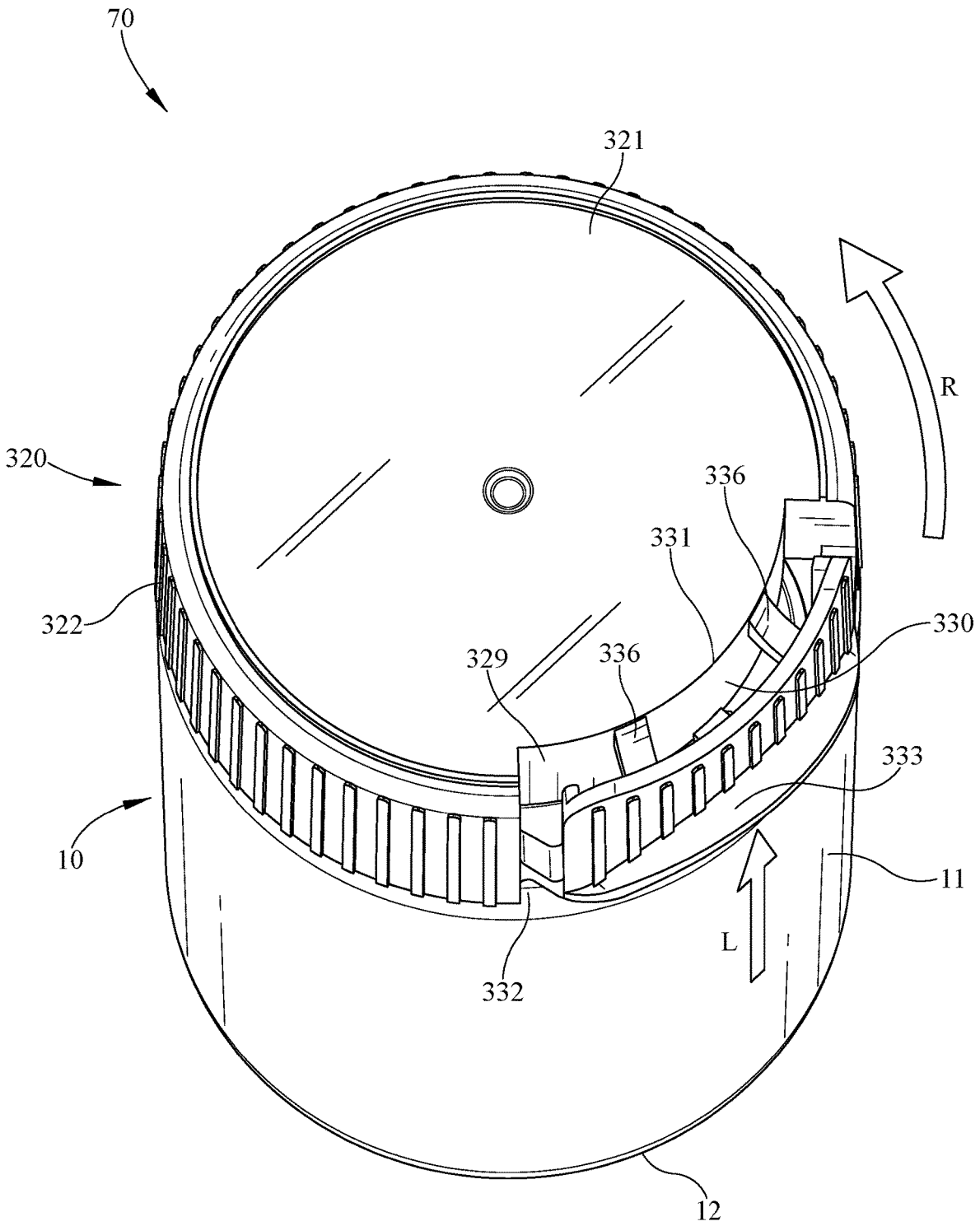
FIG. 16 illustrates a perspective view of still another embodiment of a package including a container and a closure in a locked position and a closed position.
Figure 17:
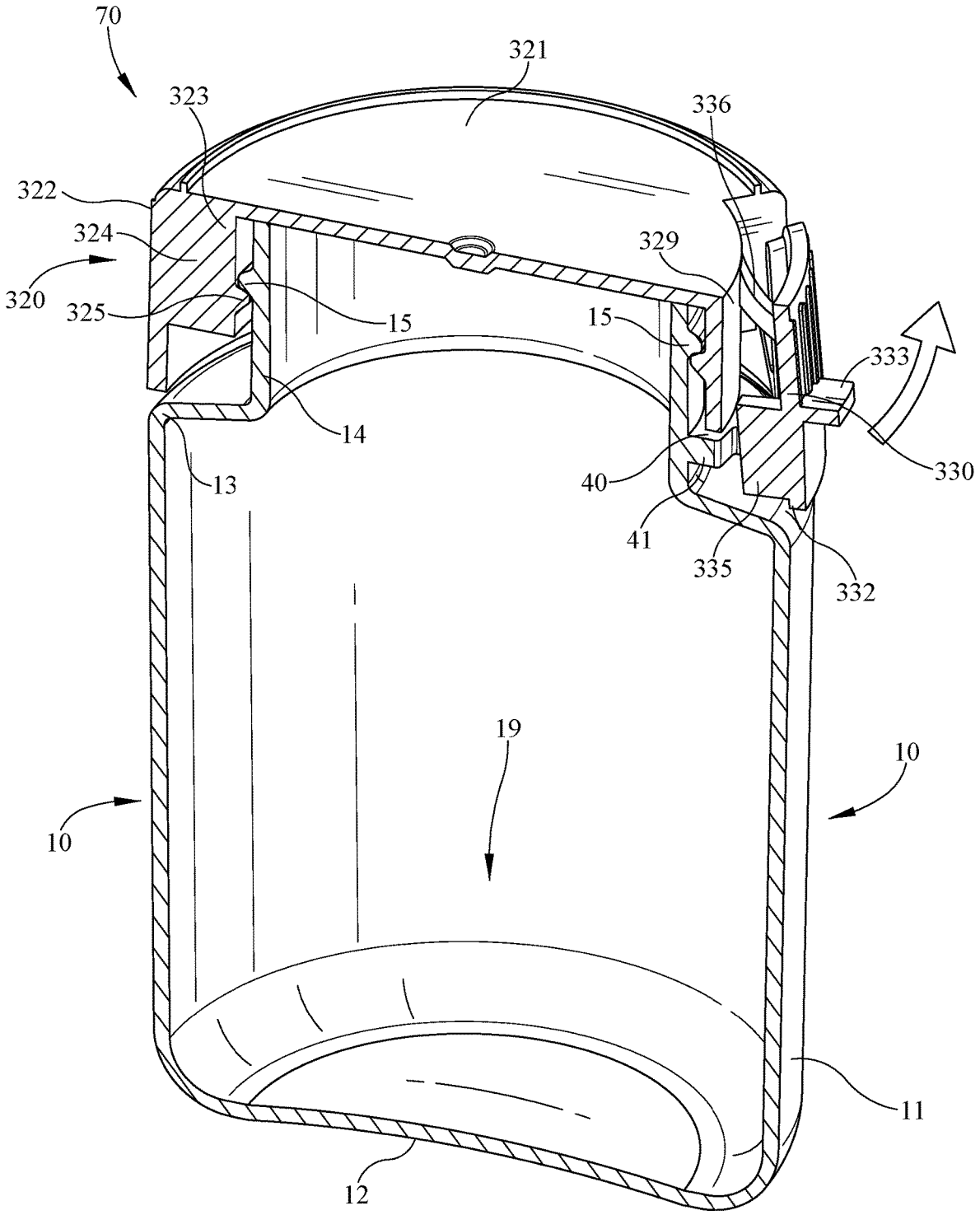
FIG. 17 illustrates a perspective cross-section view of the package of FIG. 16 in an unlocked position and a closed position.

FIGS. 16 and 17 show a fourth embodiment of a package 70, including container 10, a closure 320, and a key 330. FIG. 16 shows a perspective view of package 70 in a closed position and a locked position that, when subject to lift L and rotation R, may be moved to an unlocked position and an open position, substantially as described above in relation to packages 5, 50, and/or 60. In principle, package 70 operates similarly to package 60. A difference between the third embodiment of package 60 and the fourth embodiment of package 70 is the configuration of key arms 336 as compared to key arms 236. It is understood that virtually any number, type, and/or configuration of key arms 236 and/or 336 may be used. For example, key arms 236 and/or 336 may vary from one another or be similar, they may vary in shape, size, thickness, material composition, and/or virtually any other characteristic.

Figure 18:
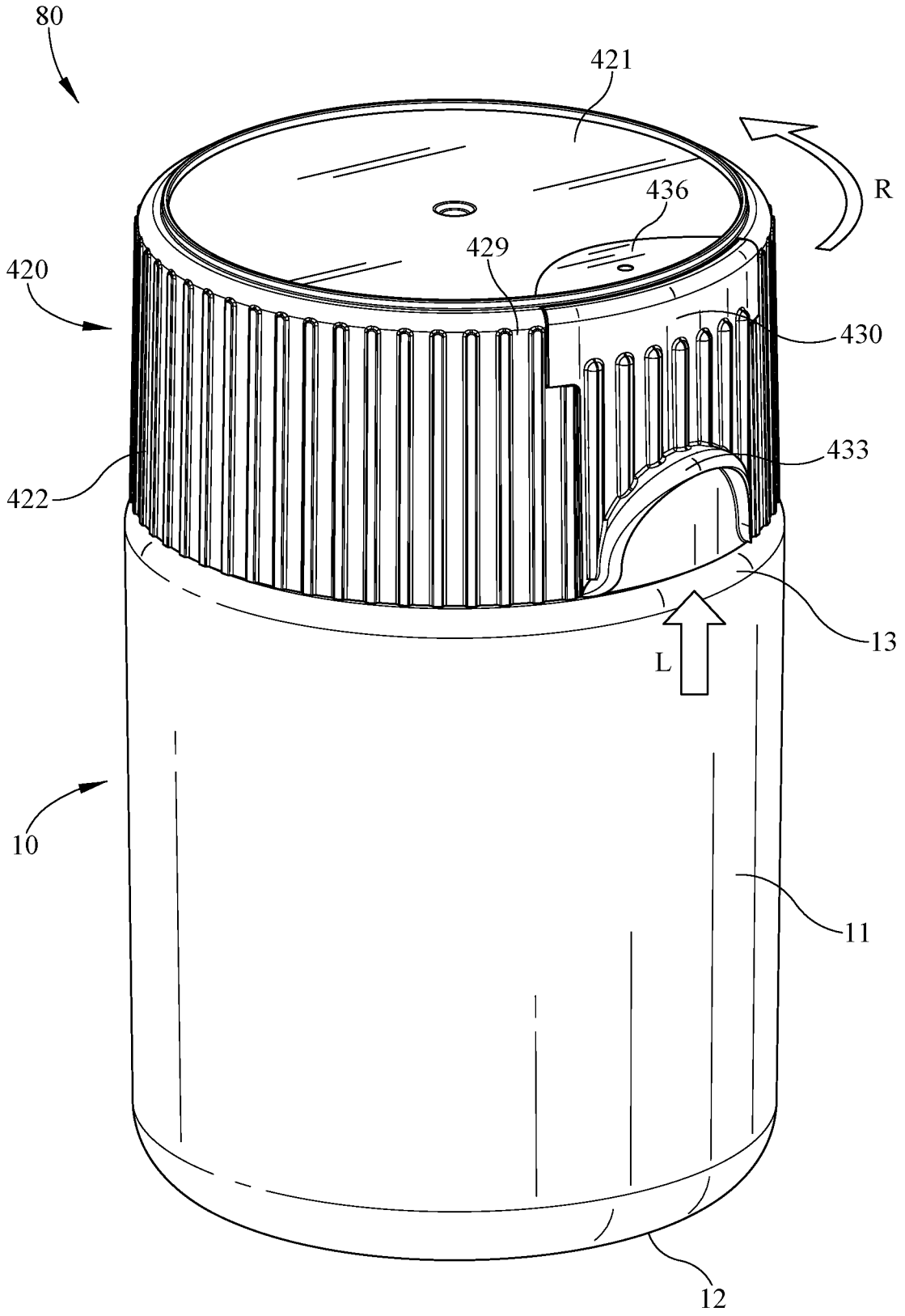
FIG. 18 illustrates a perspective view yet another embodiment of a package including a container and a closure in a locked position and a closed position.
Figure 19:
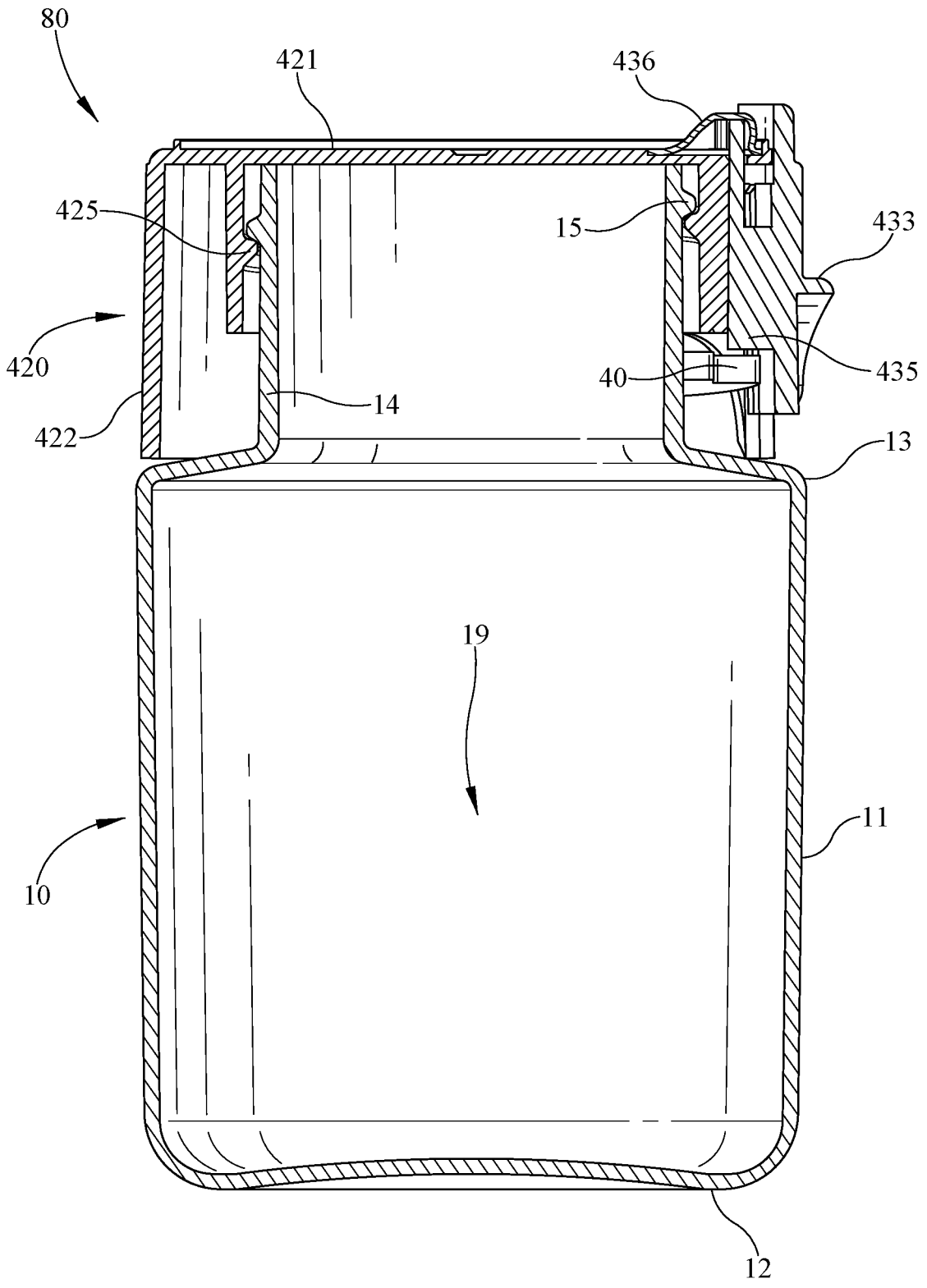
FIG. 19 illustrates a perspective cross-section view of the package of FIG. 18 in an unlocked position and a closed position.

A fifth embodiment of a package 80 is illustrated in FIGS. 18 and 19, including container 10, closure 420, and key 430. In this embodiment, a flexible area 436 may be included adjacent a cover 421 and/or the top of key 430, for any of a variety of reasons, including but not limited to providing a spring like mechanism that may be flexible enough to allow upward or vertical movement and/or sliding of key 430 relative to closure 420 while also providing an elastic biasing mechanism tending to return key 430 to the locked position from the unlocked position. In use, for example, when key 430 is subject to a first user input, such as an upward pushing or lifting force L, key 430 may move from a locked position in which it blocks, prevents, or inhibits rotation R and/or removal of closure 420 from container 10 to allow access to product storage region 19, by the flexing and/or deformation of flexible area 436. Flexible area 436 may be configured to return to its shape, for example, to bias key 430 toward the locked position so the key 430 may tend toward the locked position in the absence of the first user input. Flexible area 436 may be, for example, formed of or to include a thinned web of material and/or a plastics or elastomeric material, such as TPE, for example.

It is understood that packages 5, 50, 60, 70, 80 and/or any component thereof may be made of any of a variety of materials, including, but not limited to, any of a variety of suitable plastics material, any other material, or any combination thereof. Suitable plastics material may include, but is not limited to, polyethylene terephthalate (PET), polyethylene (PE), polypropylene (PP), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that packages 5, 50, 60, 70, 80 or any component thereof may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of packages 5, 50, 60, 70, 80.

It is further understood that any of a variety of processes or combination thereof may be used to form packages 5, 50, 60, 70, 80 and/or container 10, any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, container 10 and/or any component thereof may be formed substantially of injection stretch blow molded PET, although other materials and forming processes may be used instead of or in addition to PET and injection stretch blow molding, respectively. Various materials and/or processes may be used to form packages 5, 50, 60, 70, 80 and/or any component thereof as will be understood by one of ordinary skill in the art. In some embodiments, container 10 may be substantially a one-piece design and/or substantially formed as an integral or unitary structure.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A package, comprising:

a container defining a product storage region; and a closure coupled to the container and covering the product storage region and blocking access to the product storage region when in a closed position;

wherein the closure includes a cover, an outer skirt, and an inner skirt, wherein the outer skirt and inner skirt depend downwardly from the cover and the inner skirt is disposed radially inwardly of the outer skirt;

wherein the closure includes a key, wherein the key is selectively movable relative to the closure outer skirt by a first user input between a locked position and an unlocked position;

wherein the key includes a key protrusion in alignment with a neck blocking tab coupled to a neck of the container when the key is in the locked position blocking rotation of the closure relative to the container, and wherein the key protrusion is moved out of alignment with the neck blocking tab when the key is in the unlocked position allowing rotational removal of the closure from the container by a second user input moving the closure from a closed position to an open position;

wherein the key includes a key grip configured to allow a user to provide the first user input by the key grip in a vertical direction transverse to a radial direction of the closure; and wherein the key is movable in the vertical direction when the key is moved from the locked position to the unlocked position.

2. The package of claim 1, wherein the key includes at least one flexible member that allows movement of the key from the locked position to the unlocked position.

3. The package of claim 2, wherein the at least one flexible member of the key biases the key toward the locked position when in the unlocked position to provide a key that tends toward the locked position in the absence of the first user input.

4. The package of claim 3, wherein the at least one flexible member is a key body interposed between the key grip and a closure cover.

5. The package of claim 3, wherein the at least one flexible member is a key arm interposed between the key and an inner skirt of the closure.

6. The package of claim 3, wherein the at least one flexible member is a flexible area comprising an elastomeric spring-like member, wherein the flexible area is at least one of included in the cover of the closure and adjacent the cover of the closure.

7. The package of claim 6, wherein the key slides in the vertical direction relative to the outer skirt of the closure to move between the locked position and the unlocked position.

8. The package of claim 1, wherein the key connects to at least one of the inner skirt of the closure and the outer skirt of the closure, and the cover at a hinge area, wherein the key is at least partially rotatable about the hinge area to move between the locked position and the unlocked position.

9. A closure for forming a child-resistant package when combined with a container, the closure comprising:

a cover;

an outer skirt depending downwardly from the cover adjacent an outer periphery of the cover;

an inner skirt depending downwardly from the cover and disposed radially inwardly of the outer skirt in a radial direction;

a skirt thread on an inner surface of the inner skirt configured to releasably engage a thread of the container;

a key coupled to at least one of the outer skirt and the inner skirt, wherein the key is movable by a user input from a locked position to an unlocked position;

wherein the key is moved in a vertical direction that is transverse to the radial direction when moved between the locked position and the unlocked position; and wherein the key includes a key grip configured to allow a user to provide the user input by pushing the key grip in the vertical direction.

10. The closure of claim 9, wherein the key connects to the at least one of the inner skirt of the closure, the outer skirt of the closure, and the cover at a hinge area, wherein the key is at least partially rotatable about the hinge area to move between the locked position and the unlocked position.

11. The closure of claim 9, wherein the key includes at least one flexible member that allows movement of the key from the locked position to the unlocked position, wherein the at least one flexible member of the key biases the key toward the locked position when in the unlocked position to provide a key that tends toward the locked position in the absence of the first user input.

12. The closure of claim 11, wherein the at least one flexible member is a key body interposed between the key grip and the cover.

13. The closure of claim 11, wherein the at least one flexible member includes at least two key arms interposed between the key and the inner skirt of the closure.

14. The closure of claim 11, wherein the at least one flexible member is a flexible area in the cover comprising an elastomeric spring-like member.

15. The closure of claim 14, wherein the at least one flexible member includes thermoplastic elastomer (TPE).

16. The closure of claim 9, wherein at least a portion of the key grip extends radially outwardly farther than the outer skirt.

17. A package, comprising:

a container having a floor, a side wall, and a neck, wherein the floor and side wall at least partially defining a product storage region;

a blocking tab coupled to and extending radially outwardly from the container neck;

a closure having a cover configured to block access to the product storage region when the closure is in a closed position, the closure having an inner skirt and an outer skirt, wherein the outer skirt is located outwardly of the inner skirt in a radial direction;

a key coupled to the closure and movable by a first user input in a vertical direction from a locked position to an unlocked position, wherein the vertical direction is transverse to the radial direction;

the closure inner skirt having an internal thread configured to engage an external thread of the container neck and configured to allow rotational movement by a second user input between a closed position and an open position;

wherein rotation in a direction moving the closure from the closed position to the opened position is blocked by interaction of the neck blocking tab of the container and a key protrusion of the key;

the key being coupled to at least one of the inner skirt and outer skirt;

the key extending from a key grip area configured to be actuated in the vertical direction toward the closure cover by the first user input; and at least one flexing member that accommodates movement when subject to the first user input between the locked position and the unlocked position, wherein the flexing member is biased toward the locked position so that the key tends to return to the locked position in the absence of the first user input.

18. The package of claim 17, wherein the flexing member is a key body.

19. The package of claim 17, wherein the flexing member is at least one key arm coupling the key grip and at least one of the inner skirt and outer skirt.

20. The package of claim 17, wherein at least a portion of the key grip extends radially outwardly farther than the outer skirt.

* * * * *